US005115600A

United States Patent [19]

Kataoka et al.

[11] Patent Number: 5,115,600

[45] Date of Patent: May 26, 1992

[54] DRESSING METHOD AND APPARATUS FOR SUPER ABRASIVE GRINDING WHEEL

[75] Inventors: Shigeaki Kataoka, Shizuoka; Shigeharu Kobayashi, Yokohama; Fukuzo Yagishita, Shizuoka, all of Japan

[73] Assignee: Fuji Seiki Machine Works, Ltd., Shizuoka Prefecture, Japan

[21] Appl. No.: 528,922

[22] Filed: May 25, 1990

[51] Int. Cl.[5] ..... B24C 3/00

[52] U.S. Cl. ..... 51/410; 51/5 D; 125/11.01

[58] Field of Search ..... 51/410, 438, 5 D, 319, 51/320, 321, 427; 125/11.01, 26, 27

[56] References Cited

U.S. PATENT DOCUMENTS

| | | | |
|---|---|---|---|
| 2,200,587 | 5/1940 | Tirrell | 51/321 X |
| 3,584,841 | 6/1971 | Field | 51/436 X |
| 4,330,968 | 5/1982 | Kobayashi et al. . | |
| 4,642,944 | 2/1987 | Fairhurst | 51/436 |
| 4,669,230 | 6/1987 | Suzuki et al. . | |

FOREIGN PATENT DOCUMENTS

| | | | |
|---|---|---|---|
| 49-6276 | 2/1974 | Japan . | |
| 278763 | 11/1988 | Japan | 125/11.01 |

OTHER PUBLICATIONS

Paper from German technical magazine "Industrie-Anzeiger" by Dr. Salje, Mar. 27, 1985, pp. 98 and 100.

"Application of EDM into the Trueing/Dressing of Metal Bond Super Abrasive Wheels", by K. Suzuki et al., 4 pages.

SME Technical Paper "Abrasive Jet Machining", Society of Manufacturing Engineers, 1977, 9 pages.

Drawings and English Translation of Japanese Publication No. 219 185/84, Yasuo Tsujigoo et al., Dec. 10, 1984, 4 pages.

Pages 4–19 of the text "Granding of Cermic Material" from a technical meeting held by the Tokyo Technical Research Center.

"New Dressing Method for CBN Wheel", by M. Daimon and T. Ishikawa (5 pages).

English translation of Japanese Publication No. 59-219158, May 19, 1983, Yasuo Tsujigoo et al., (4 pages).

"Dressing of the Diamond Wheel Using Wet Blasting Process", by Fukuzo Yagishita et al., Nov. 1989, Japanese and English translation, (9 pages).

"Application of EDM into the Trueing/Dressing of Metal Bond Super Abrasive Wheels", by K. Suzuki et al., Jun. 25, 1990, (4 pages).

Japanes paper & Translation, Fukuzo Yagishita et al., Dressing of the Diamond Wheel Using Wet Blasting, Nov. 1989, 7 pgs.

*Primary Examiner*—M. Rachuba

*Attorney, Agent, or Firm*—Flynn, Thiel, Boutell & Tanis

[57] ABSTRACT

A method and apparatus for removing clogging material from between abrasive grains of a grinding wheel. A pressurized blasting fluid is supplied to a blasting gun, which in turn sucks an abrasive particle-liquid slurry into the gun. The slurry is entraining in the stream of blasting fluid, causing the liquid to be broken down into mist particles, and the resultant stream is discharged against the surface of the grinding wheel at a pressure in the range of 2.0 to 3.5 kg/cm$^2$.

6 Claims, 5 Drawing Sheets

BEFORE BLASTING

AFTER BLASTING

BEFORE BLASTING

AFTER BLASTING

BEFORE BLASTING

AFTER BLASTING

DRESSING METHOD AND APPARATUS FOR SUPER ABRASIVE GRINDING WHEEL

FIELD OF THE INVENTION

This invention relates to a dressing method, and an apparatus for such dressing method, for effectively removing clogging material from between abrasive grains of a super abrasive grinding wheel.

BACKGROUND OF THE INVENTION

For grinding ceramic materials, various types of super abrasive grinding wheels bonded by different kinds of materials are used. In this grinding operation, clogging occurs between wheel grains on the peripheral surface of the grinding wheel. Cutting action of the grains is reduced by the presence of removed stock between the grains, and the cutting edges of wheel grains are almost covered by removed stock. This is called clogging.

Clogging not only reduces grinding efficiency, but also generates minute vibrations of the wheel. This vibration is caused by two factors, i.e. resistance of the workpiece to be ground against the grinding action of the grinding wheel and the revolving movement of the grinding wheel, each of which affects the other element. Smoothly finished surfaces can not be achieved due to this minute vibration. Elimination of clogging is strongly desired in order to achieve long exposure of cutting edges of the super abrasive grains.

Conventional methods hitherto used to remove clogging, are:

(1) Use of a hand stick for dressing, which stick has a diamond grain, and (2) Use of a crushing roll made of hardened tool steel or sintered abrasive grains.

The above methods have a common difficulty in that both methods remove clogging on the periphery of the grinding wheel and expose cutting edges of abrasive grains together with the bonding material which keeps the grains on the wheel surface. Especially, when the hand-stick type of tool is used, application of the tool on the grinding wheel requires a delicate touch and careful craftsmanship so as to not remove the wheel grains together with the clogging material.

There are other known dressing methods. These are:

(1) A method which ejects highly pressured (more than 100 kgf./cm.cm.) grinding lubricant on the wheel surface and blows off clogging material, (2) A method which ejects highly pressurized grinding lubricant mixed with abrasive grains on the surface of the grinding wheel (Japanese Provisional Patent Application Sho59 (1984) - 219 158), (3) A method which discharges grinding lubricant and abrasive grains separately between the grinding wheel and the crushing roll (Japanese Provisional Patent Application Sho54 (1979) - 141 487), and (4) A method which blasts abrasive particles such as Alumina particles from a blasting gun by a highly pressurized (4 kgf./cm.cm.–6 kgf./cm.cm.) air stream, and generates cutting edges on abrasive grains of the grinding wheel.

The above methods which remove clogging of grinding wheels using pressurized liquid or a mixture of abrasive particles and liquid, need to have special apparatus to practice each method. The pressure used to cause removal of clogging material is rather high, and often removes the bonding material which keeps super abrasive grains on the surface of the grinding wheel. As a result, the bonding strength is weakened and usable abrasive grains drop from the wheel surface during grinding.

In another known method which uses air blasting of dry abrasive particles for dressing, the impact force of blasted abrasive particles can be adjusted by regulating the air pressure used as an accelerating force for the particles. But, in real practice, adjustment is difficult. If the pressure of the air is too high, usable grains on the wheel drop off. If the pressure of the air is too weak, dressing is not enough. Also, reclaiming blasted abrasive particles, and air circulation for re-use is difficult.

As mentioned above, conventional dressing methods and related apparatus can not suitably satisfy conditions demanded for dressing of grinding wheels.

Thus, the present invention offers a new dressing method for super abrasive grinding wheel which works steadily using low fluid pressure, and an apparatus suitable to practice this invention. More specifically, the invention relates to a method which uses gentle wet blasting for effectively dressing clogged grinding wheels.

To solve problems as mentioned in the above paragraphs, the dressing method of this invention uses a slurry containing 10% or less percentage of abrasive particles relative to the total volume of the slurry. This slurry is induced into a blasting gun which uses pressurized fluid as a source of blasting energy. The slurry is blasted by the gun against a surface of a super abrasive grinding wheel with an ejecting pressure of 2.0 to 3.5 kgf./cm.cm. and, in the blasting process, the liquid in the slurry is mistified and said mist accompanies the abrasive particles to assist in washing away the clogging material.

In the method described above, mist of liquid and abrasive particles are blasted against the periphery of a rotating super abrasive grinding wheel in such way that the direction of line of blasting is normal to the circumference of the grinding wheel or along a line deviating from normal within a few degrees thereof (i.e. from 0° to 10°) and toward the direction of turning of the revolving wheel.

In the apparatus embodying this invention, a slurry transportation device is provided in which slurry flowing down through an outlet located at the bottom of a slurry reservoir is connected with an upward opening of a three-opening connector. Another opening of the connector is for delivering slurry. A nozzle with a tapered inside hole is mounted detachably and exchangeably in this delivery opening. The remaining opening is in alignment with the delivery opening and is connected to an upper part of the slurry reservoir by bypass piping. An outlet of the bypass piping opens into a tapered nozzle hole defining the delivery opening so that liquid from the upper part of the slurry reservoir flows down through the bypass piping and is discharged into the tapered nozzle hole.

In the blasting gun, the mixture of liquid and abrasive particles (i.e. slurry is induced into the blasting gun, and is ejected with a highly pressurized fluid discharged from a jet part mounted in the blasting gun. The highly pressurized fluid may be supplied from a separate pressure intensifier apparatus which raises the pressure to such level that slurry is sucked and accelerated by a jet stream of the fluid when the fluid is discharged from the jet part of the blasting gun.

In the method of the present invention, slurry including abrasive particles and water in which abrasive particles occupies a maximum of 10% in volume ratio, is blasted to a super-abrasive grinding wheel with a blasting pressure at exit of the nozzle of 2.0 to 3.5 kgf./cm.cm. Blasted abrasive particles hit the stock removed by the grinding wheel and stuck between abrasive grains of the wheel, and remove said stock sticking between the wheel grains. Mistified water washes off said removed stock and eliminates clogging on the wheel surface.

Wear of bonding material existing between wheel grains can be lessened by setting the direction of the blasting stream of abrasive particles and mistified liquid along a line normal to the periphery of the wheel or along a line almost equal to the normal line but with a few degrees of deviation from said normal line, which deviation is opposed to the direction of wheel rotation.

In the device for transporting slurry, vacuum created at the mixing nozzle sucks liquid reserved in the slurry reservoir through bypass piping, and this liquid is sent to the gun. Flow generated at the mixing nozzle fluidizes accumulated grains at the joint section of the three way connector, and sends abrasive particles together with liquid to the blasting gun. In this mixing of abrasive particles and liquid, the ratio of solid particles and liquid in slurry can be adjusted to keep the volume ratio of solid particles to liquid no more than 10% of the total volume.

In the blasting gun, a pressure intensifier separate from the device can be used. This pressure intensifier uses another high pressure fluid as a driving force and pressurizes another liquid (water) above ambient pressure. Pressurized liquid is sent to the blasting gun, and sucks slurry. Blasting pressure at exit of the blasting nozzle can be controlled between 2.0 to 3.5 kgf.cm.cm. by regulating the pressure of fluid and adjusting the size of air port in the gun.

DETAILED DESCRIPTION

Figure 1:
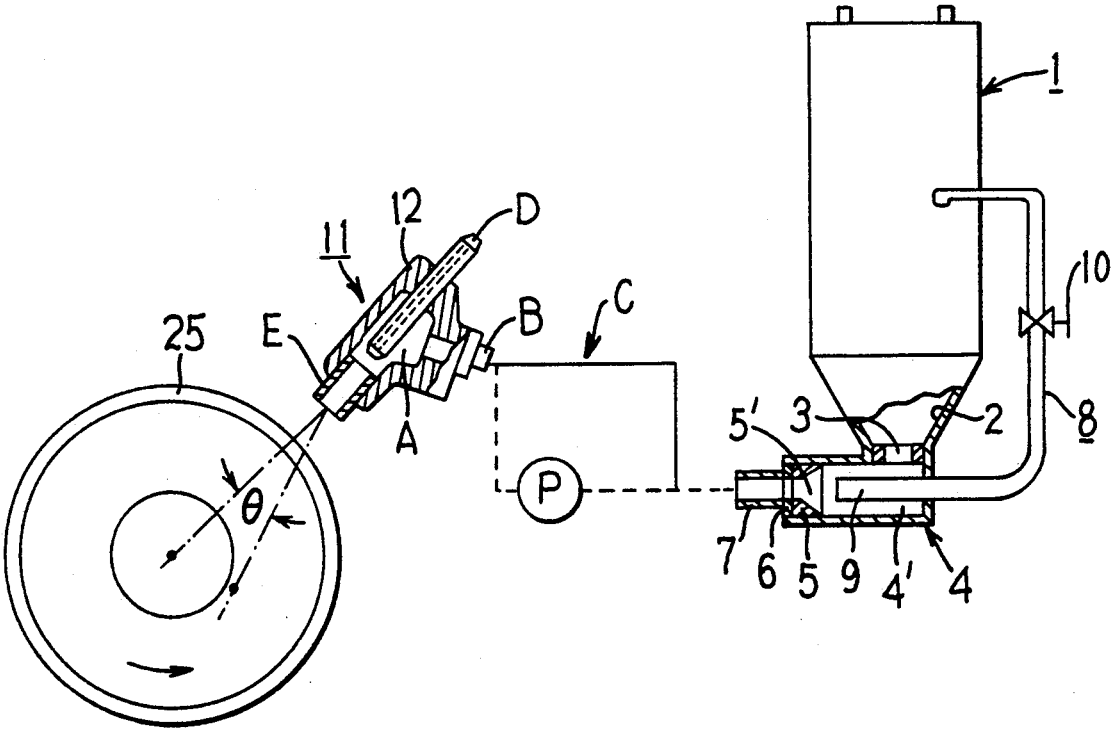
FIG. 1 is a diagrammatic representation of an apparatus for accomplishing the method of the invention according to a first embodiment.

The method of the present invention will be explained by way of example with reference to FIG. 1. Slurry having a maximum volume ratio of abrasive particles to liquid of about 1 to 9, or 10% solid particles in the total volume, is preferably used. A slurry transportation device which is used with the slurry is shown in FIG. 1.

A mixture of abrasive particles and liquid, or slurry, is contained in a slurry reservoir 1. The slurry reservoir 1 has at its lower end an inverted cone-shaped end portion 2. The lower or apex end of said portion 2 has a discharge opening or exit 3 for liquid and abrasive particles which pass through it into a connection section 4 which is mounted at but below the discharge opening 3. This connecting section 4 has three openings or ports therein.

One end of this connection section 4 has a mixing nozzle 5 detachably and exchangeably mounted therein. This mixing nozzle 5 fits inside of said connecting section 4 and is retained by a flange 6. The nozzle has a tapered discharge opening 5' therethrough for communication with one end of the passage 4'. By providing a number of different mixing nozzles 5 having different sizes of bores 5', the mixing ratio of liquid and abrasive particles can be adjusted. The outlet end of the connecting section 4 is coupled with a connecting tube 7, which is adapted for connection with the slurry circuit.

The upper side of connecting section 4 joins directly to the bottom of reservoir 1, which upper side is open so that the discharge opening 3 communicates directly with the passage 4'.

The ejecting section 9 of a bypass pipe 8, which connects to the upper part of the slurry reservoir 1 and induces clear water from the upper part of the slurry reservoir 1 into said connecting section 4, projects coaxially into the passage 4' and discharges close to and substantially coaxially into the mixing nozzle 5. The bypass pipe 8 is provided with a flow control valve 10 substantially at its middle. Flow of clear water from slurry reservoir 1 to the mixing nozzle 5 can be regulated by this valve 10.

The mixing ratio of liquid and solid particles can be adjusted in a mixing ratio of from 1 to 10 parts of solid and 100 parts of liquid. Slurry, of which the concentration is in the above-mentioned range, is sent to the blasting gun.

If the solid/liquid volume ratio of slurry happens to exceed said range of mixing ratio, i.e. if more than 10% solid particles are ejected, then the ejected particles tend not to be accelerated as single particles but rather are blasted as cohering groups of particles. Such groups of particles do not give even impact on the surface of the grinding wheel, and this is not desirable.

The blasting gun 11 has a slurry chamber A within its body 12. The gun body has a slurry inlet B communicating with the slurry chamber A, and the inlet B connects to the connecting pipe 7 of the slurry transportation device through a slurry circuit C. An air jet nozzle D is mounted in the gun body 12 in such way that a front discharge end of the air jet nozzle is located substantially in the middle of the slurry chamber A and the nozzle D is elongated outwardly through the other end of the chamber. Compressed (i.e. pressurized) air at a pressure of about 2 to about 3.5 kgf./cm.cm. (about 28 to about 50 psi) is supplied to the outer end of this air jet nozzle D from a suitable source (not shown). On the opposite end of the slurry chamber, a blasting nozzle E is mounted. The air stream ejected from the air jet nozzle D creates a vacuum in the slurry chamber A and sucks slurry from the slurry circuit through inlet B. A compound stream comprising solid particles, liquid and air is ejected from the blasting nozzle E in such state that the blasting pressure is about 2.0 to about 3.5 kgf./cm.cm. and the velocity of ejected solid particles is in the range of about 50 to about 100 meters per second. This compound jet stream blasts the surface 25 of a super abrasive grinding wheel.

If the ejecting pressure at the ejecting nozzle E is less than 2 kgf./cm.cm., the impact force of abrasive particle is too weak to knock off stock stuck between abrasive grains of the grinding wheel. On the other hand, if said ejecting pressure is higher than 3.5 kgf./cm.cm., then blasted particles abrade the bonding material which holds the abrasive grains on the wheel so that usable abrasive grains drop off or are loosened.

The following is an example embodying the present invention constituted as described above. Compressed air of 2.0 to 3.5 kgf./cm.cm. is sent to the blasting gun 11 and ejected from the air jet nozzle D. Vacuum created by this ejected air stream in chamber A sucks slurry through the connecting tube 7 from the mixing nozzle 5 of the connecting section 4.

Usually, abrasive particles settle in the connecting section 4 and the annular passageway 4' in the connecting section which surrounds the lower end portion of tube 8 becomes clogged by settled abrasive particles. Clear liquid in the upper part of the slurry reservoir 1 is sucked by the vacuum force created in the blasting gun through the bypass tube 8 and slurry circuit C. Clear liquid is sent to the blasting gun 11 through the delivery section 9 and the mixing nozzle 5. Settled abrasive particles in connecting section 4 are gradually entrained with the liquid stream discharging from the bypass tube 8 to make a slurry at the mixing nozzle 5, which slurry flows to the blasting gun 11.

By adjusting the control valve 10, flow of clear liquid through bypass 8 can be controlled. A suitably sized mixing nozzle 5 can be selected and fitted inside of the connecting section 4. By accommodating flow of clean liquid from the slurry reservoir and a suitable mixing nozzle, the concentration of slurry can be adjusted so that the abrasive particle part volume is 10% or less of the whole slurry volume.

A slurry pump P can be used in place of suction force of the blasting gun to send slurry to the blasting gun. In the case where the slurry pump is provided in the slurry circuit, the delivery pressure of the slurry pump would be lower than 1 kgf./cm.cm. and desirably about 0.5 kgf./cm.cm.

In the blasting gun 11, slurry from slurry circuit C and the compressed air stream from jet part D are mixed in the slurry chamber A. Abrasive particles and mistified liquid are blasted by the ejecting air pressure of 2.0 to 3.5 kgf./cm.cm. against the surface of the super abrasive grinding wheel. Clogging between abrasive grains is dropped off.

Figure 2:
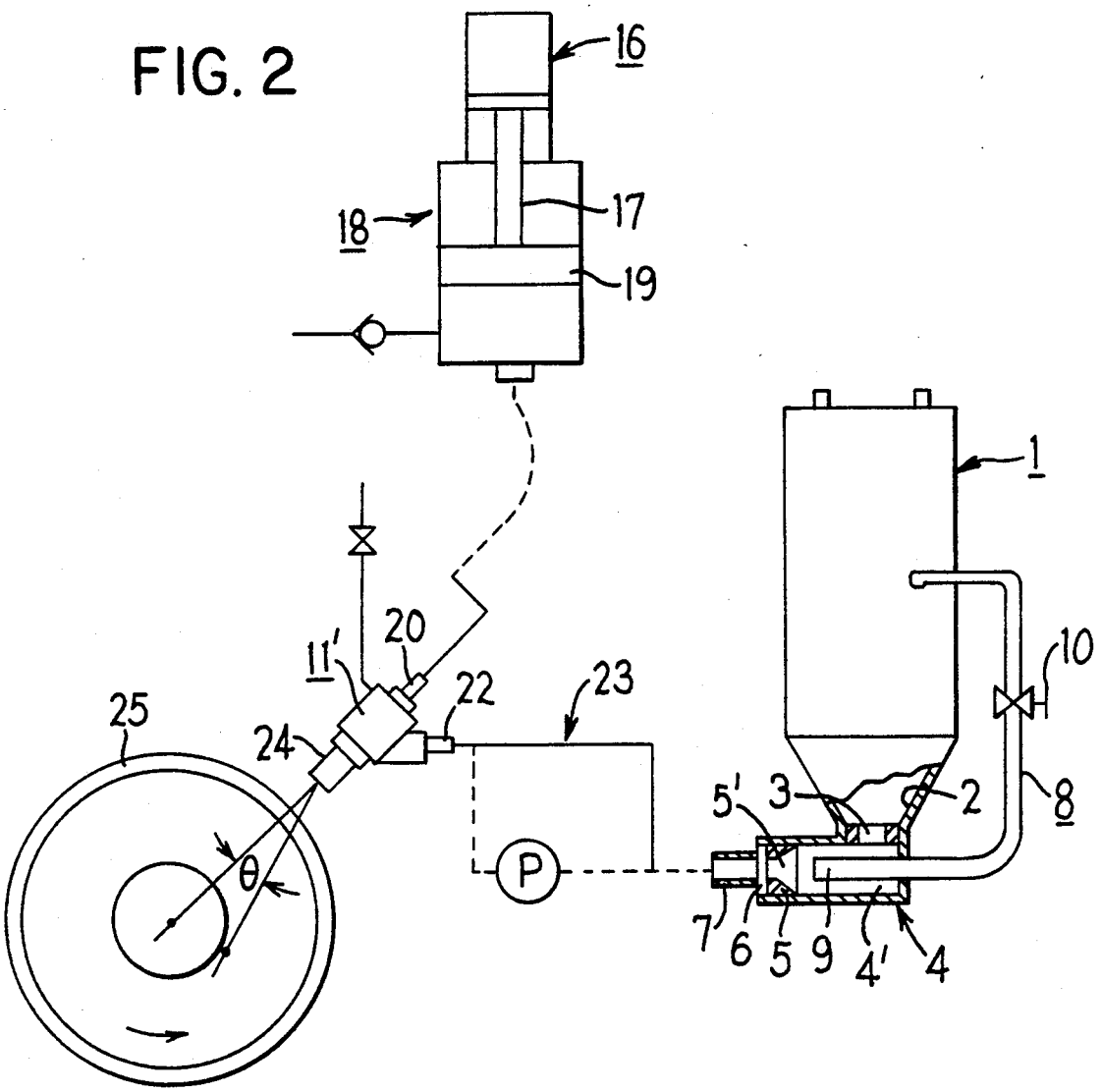
FIG. 2 is a schematic representation for accomplishing the inventive method according to a second embodiment.

Next, a second example of the invention is described with reference to FIGS. 2 and 3. In this example, the slurry transportation device is the same as in FIG. 1 so that its description is omitted. The same symbols as used on FIG. 1 are also used in FIGS. 2 and 3 to designate the same parts.

Figure 3:
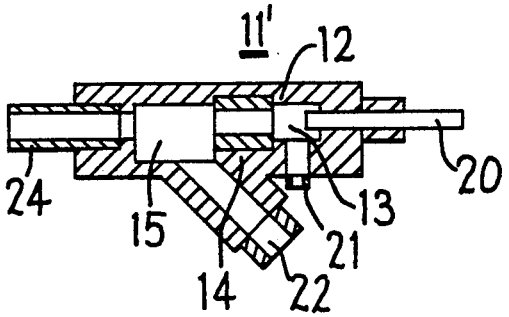
FIG. 3 is an enlarged sectional view of the blasting gun used in the apparatus of FIG. 2.

The blasting gun 11' comprises, as shown in FIG. 3, a gun body 12, a first mixing chamber 13 for liquid and gas, an intermediate ejecting nozzle 14 for a mixture of gas and liquid, and the second or slurry chamber 15. A jet nozzle 20 is provided on the gun body 12 and opens coaxially into the mixing chamber 13. Said jet nozzle 20 connects at its rear end with a fluid cylinder 18 of a pressure intensifier. The piston 19 in the cylinder 18 couples with the rod 17 in the hydraulic cylinder 16. These two hydraulic cylinders and pistons with common rod comprises a pressure intensifying device, and this devices sends pressurized liquid to the jet nozzle 20 through a supply line.

An ambient air inlet 21 as provided on the middle of the gun body 12 opens into the liquid and air mixing chamber 13. Slurry inlet 22 is provided on the gun body 12 at an inclined angle relative to the centerline of the gun. This slurry inlet 22 is connected to the connecting tube 7 of the slurry transporting device through slurry circuit 23. The blasting nozzle 24 is connected to the slurry chamber 15. A compound jet stream comprising (1) pressurized liquid supplied by the pressure intensifier and (2) air induced from air inlet 21 is ejected from the mixing nozzle 14 into chamber 15 and sucks and accelerates slurry from the slurry circuit. Thus, a compound fluid of air, liquid and solid particles is ejected from the blasting nozzle 24 with the ejecting pressure at the blasting nozzle being 2.0 to 3.5 kgf./cm.cm. and the Velocity of the abrasive particles being 50 to 100 meters/second. The blasted stream hits the surface of the super-abrasive grinding wheel.

In the above apparatus, the pressure intensifier 18 delivers pressurized liquid (usually water) at about 30 kgf./cm.cm. pressure. The pressurized water is sent to the blasting gun 11 and is ejected from the blasting nozzle 24. Slurry is sucked through the connecting tube 7 by vacuum created in slurry chamber 15, as described above relative to the apparatus of FIG. 1. The volume ratio of solid particles is maintained at 10% or less relative to the total slurry volume.

In the blasting gun, the pressure intensifier, which is driven by an oil pump, sends liquid to the blasting gun at a pressure of 30 kgf./cm.cm. or lower. This pressurized liquid is delivered through jet nozzle 20. Air is induced from the air inlet 21 by ejection of liquid from jet nozzle 20 into chamber 13. Induced air is mixed with liquid in the mixing chamber 13. The jet stream including air is ejected from the nozzle 14 into the slurry chamber 15. In the slurry chamber 15, the mixed stream of liquid and air sucks slurry through inlet 22 from the slurry circuit and accelerates both solid particles and liquid. A compound jet stream of solid particles, liquid and air bubbles is discharged from nozzle 24 for blasting a peripheral surface of the grinding wheel. Blasting pressure at the blasting nozzle 24 is in the range of 2.0 to 3.5 kgf./cm.cm. Clogging of removed stock of ground workpiece as disposed between the abrasive grains of the wheel surface are knocked off by impact of the blasted grains and mistified liquid.

A few types of grinding wheels used for finishing ceramic materials were selected for test pieces. The types of grinding wheels are as follows:

| | | Diamond Mesh size |
|---|---|---|
| (1) Segment block of cup wheel, bonded by cast iron: SD(grain size) FC | Grain - | #100<br>#600 |
| (2) Resinoid bonded wheel - SD(grain size) B | Grain - | #400 |

-continued

| | | Diamond Mesh size |
|---|---|---|
| | | #600 |
| (3) Vitrified wheel - DE(grain size) R | Grain - | #270 |

These wheels were dressed by the method and apparatus of FIG. 1 after their grains were covered by removed ceramic materials which clogged the grains during grinding operations. The state of clogging before dressing and the state of the peripheral surface of the wheel after dressing are illustrated by the table, photographs and graphs.

The test conditions are shown in Table 1.

TABLE 1

Figure 6:
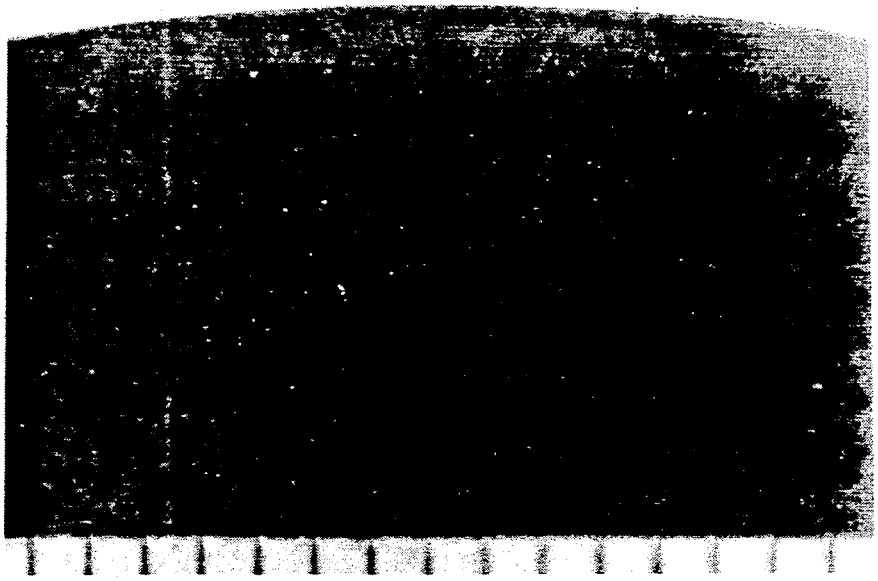
FIGS. 6 and 7 are photographs showing the state of the wheel surface of two different grinding wheels prior to dressing.
Figure 7:
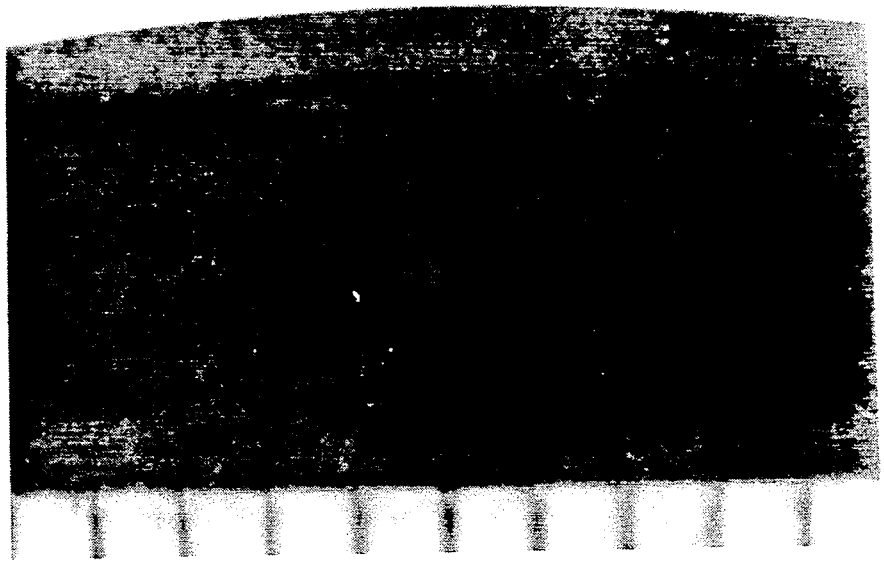

| | | Test Condition | | | | | | |
|---|---|---|---|---|---|---|---|---|
| | | Blasted Media | | | Dressing Condition | | | |
| Symbol of Drawing | Kind of Grinding Wheel | Kind | Size (in mesh size) | Concentration | Blasting Pressure (kgf/cm$^2$) | Blasting Time (sec.) | Blasting Distance (m.m.) | State of Grinding Wheel (fixed or turning) |
| | SD 100 | $Al_2O_3$ | #120 | 5% | 3.5 | 10 | 50 | Fixed |
| | SD 600 | $Al_2O_3$ | #120 | 5% | 3.5 | 10 | 50 | Fixed |
| FIG. 6, 8, 11 & 12 | SD 400 | $Al_2O_3$ | #120 | 1% | 3.0 | 20 | 50 | Fixed |
| FIG. 7, 9, 13 & 14 | SD 600 | $Al_2O_3$ | #120 | 1% | 3.0 | 20 | 50 | Fixed |
| | DE 270 | $Al_2O_3$ | #120 | 1% | 3.0 | 10<br>25<br>70 | 40 | turning 1573 rpm |
| | DE 270 | $Al_2O_3$ | #120 | 1% | 3.0 | 10<br>25<br>70 | 40 | turning 1573 rpm |
| | DE 270 | $Al_2O_3$ | #120 | 1% | 3.0 | 10<br>65<br>120 | 40 | turning 1573 rpm |

Figure 4:
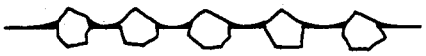
FIG. 4 is an enlarged, schematic sketch illustrating the surface of a grinding wheel before dressing is performed.
Figure 5:
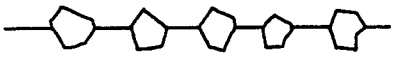
FIG. 5 is a similar schematic sketch showing the surface of the grinding wheel after dressing by the present invention.

Comments on test and test results:

FIG. 4 is an enlarged, schematic sketch showing the surface of the grinding wheel before dressing by the present invention is performed. FIG. 5 is a like schematic sketch of the surface of the grinding wheel after dressing by the present invention. As shown in FIG. 4, super abrasive grains are covered by material which is removed by grinding and which remains between the grains. After dressed by this blasting method, said material is removed and abrasive grains are exposed as shown in FIG. 5.

Figure 8:
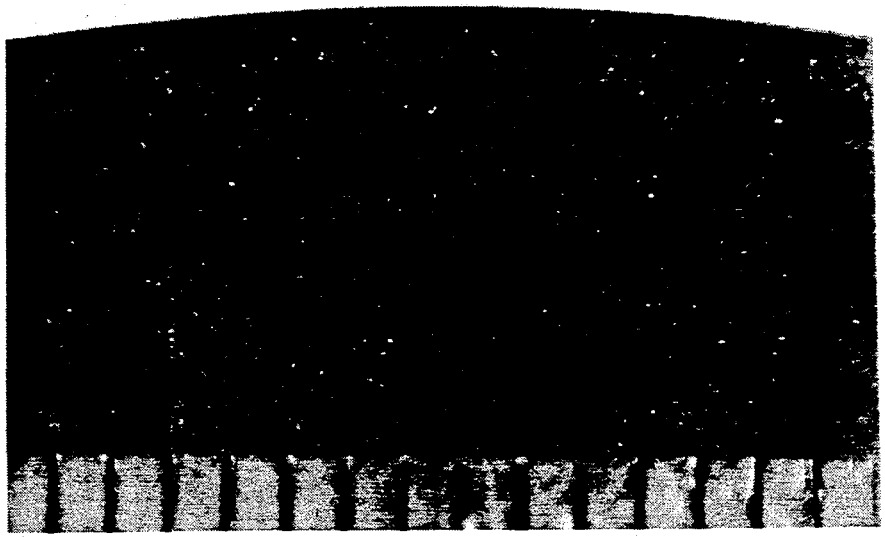
FIGS. 8 and 9 are photographs which respectively show the same wheels as in FIGS. 6 and 7 after dressing thereof according to the present invention.
Figure 9:
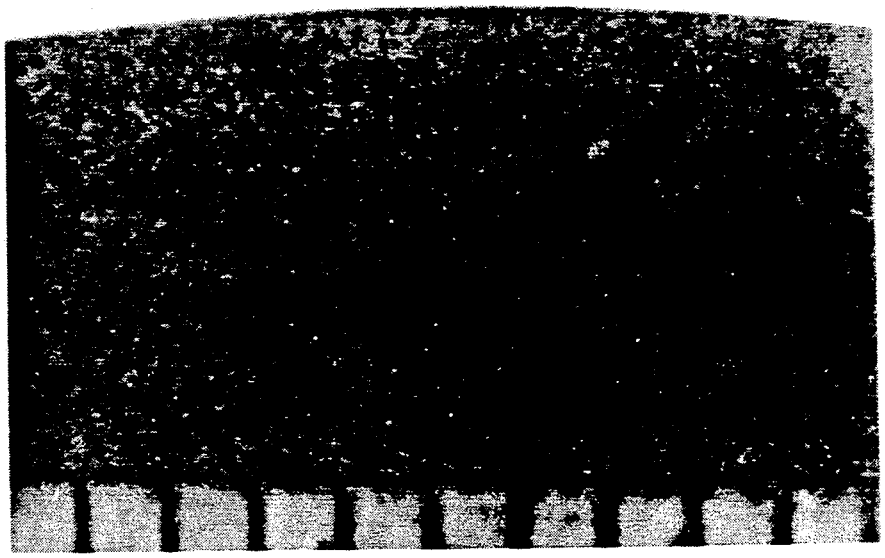

Photographs in FIGS. 6 and 7 show the state of the wheel surface before dressing. Photographs in FIGS. 8 and 9 show the state of the wheel surface after being dressed by the present invention. It shall be noted by visual inspection of the photographs that the wheel surfaces in FIGS. 6 and 7 are covered by stuck material removed by grinding action of the super abrasive wheel. However, the wheel surfaces shown in the photographs of FIGS. 8 and 9 are free of stuck material and the abrasive particles are exposed.

Figure 10:
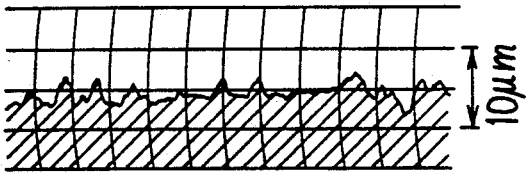
FIGS. 10 and 11 are graphs depicting surface roughness of grinding wheels before blasting.
Figure 12:
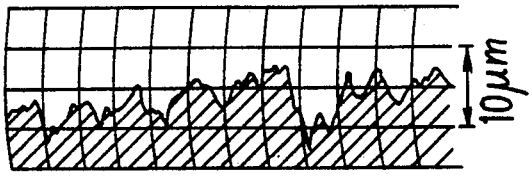
FIGS. 12 and 13 respectively correspond to FIGS. 10 and 11 and show the surface roughness of grinding wheels after dressing by the present invention.
Figure 11:
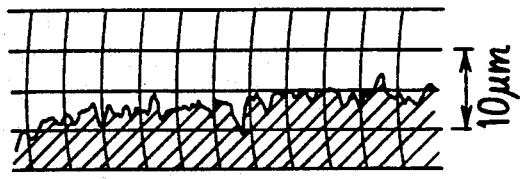
Figure 13:
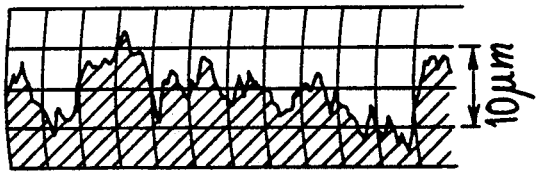

FIGS. 10 and 11 are graphs showing surface roughness of the grinding wheel. The curve showing surface roughness is gained by depressing a small block of graphite on the surface of a rotating grinding wheel to copy the averaged locus of each cutting edge of the abrasive grains. The copied surface of the graphite block is analyzed by a mechanical surface analyzer using a tracing pin. FIGS. 10 and 11 show roughness of the wheel surface before dressing, and FIGS. 12 and 13 are graphs of surface roughness after dressing of the wheel by the present invention. Comparing two groups of graphs, i.e. FIGS. 10 and 11 to FIGS. 12 and 13, it is observed that, in FIGS. 12 and 13, the difference in wave height is extremely high relative to that in FIGS. 10 and 11. This difference of total height reveals the height of grains exposed on the wheel surface.

Thus, the method embodying the present invention offers a new dressing method for super abrasive grinding wheels. Apparatus embodying this invention can remove ceramic material stuck between abrasive grains of the grinding wheel with certainty, but without wear of bonding material which holds the abrasive grains on the wheel. Usable abrasive grains are not dislodged by this dressing method.

This dressing method comprises blasting abrasive particles and mistified liquid (water) against a revolving (or fixed) surface of the grinding wheel so that an even dressing effect can be gained.

In the slurry transportation device, clogging caused by settling of abrasive particles at the passageway in the connecting section 4 can be liquified by a liquid stream flowing down from an upper part of the slurry reservoir through a bypass pipe to cause entrainment of settled particle into that flow. Slurry can be sent to the blasting gun evenly and effectively with certainty.

In the blasting gun, as shown in the second example embodying this invention, the accelerating jet stream which sucks slurry from the slurry circuit, is sent from a separate pressure intensifier which pressurizes liquid in ambient pressure by using another highly pressurized liquid, i.e. the hydraulic oil pump system as used in the grinding machine. In such case, a special pressure device is not necessary.

The term "super" abrasive grinding as used above specifically includes grinding wheels in which the abrasive grains are man-made diamond or CBN (carbon boron nitride) grains. Such super abrasive grinding wheels have excellent hardness, such as a Knoop hardness of about 7,000 for diamond grain wheels and about 4,000 for CBN grain wheels.

In the present invention, numerous conventional types of tough abrasive grains can be used for dressing the grinding wheel, although the blasting grains preferably have a grain size slightly bigger than the wheel grain size.

The embodiments of the invention in which an exclusive property or privilege is claimed are defined as follows:

1. An apparatus for dressing a super abrasive grinding wheel, comprising:

a reservoir having an internal chamber for containing a slurry of liquid and abrasive particles, said reservoir having an upper portion and a funnel-shaped lower portion which tapers toward an outlet opening at a lower end of said lower portion, said reservoir being free of means for agitating the slurry so that said abrasive particles are free to settle into said lower portion of said reservoir whereby liquid substantially free of abrasive particles becomes present in said upper portion of said reservoir, said outlet opening of said reservoir being unobstructed so that abrasive particles that settle in said lower portion of said reservoir can freely flow downwardly through said outlet opening;

a connector structure disposed below said reservoir, said connector structure having a generally horizontally extending central passageway which is closed at one axial end thereof and which has discharge means in the opposite axial end thereof, said connector structure having an entrance opening extending upwardly from said passageway between said axial ends, said entrance opening having an upper end which opens into said outlet opening in said lower portion of said reservoir and is in free, open communication therewith, said outlet opening of said reservoir and said entrance opening of said connector structure being free of valve means so that abrasive particles in said outlet opening can freely flow downwardly through said entrance opening into said central passageway and accumulate therein;

said discharge means being an annular, mixing, discharge nozzle mounted in said opposite axial end of said passageway, said mixing nozzle having a tapered discharge opening which is in axial alignment with said passageway;

a bypass conduit having a lower end portion extending through said one axial end of said passageway and then extending under and beyond said entrance opening to a location close to said mixing, discharge nozzle, said end portion providing a zone between said bypass conduit and the wall of said passageway into which abrasive particles can freely flow from said entrance opening, said bypass conduit having an upper end which is connected to the upper portion of said reservoir so that liquid substantially free of abrasive particles can flow from said reservoir into said lower end portion of said bypass conduit and thence into said passageway close to said mixing nozzle, said bypass conduit being free of pumping means so that flow of liquid therethrough is caused by means located downstream of said mixing nozzle;

an intermediate pipe connected to one end thereof to said mixing nozzle for receiving a slurry therefrom;

a blasting gun connected to the other end of said intermediate pipe so that the slurry can flow into said blasting gun, and pressure means for supplying pressurized fluid to said blasting gun to aspirate the slurry from said connector structure through said intermediate pipe into said blasting gun, to pressurize the slurry and to discharge a mist of the slurry at a pressure in the range of 2.0 to 3.5 kgf.cm.cm. for impingement against the peripheral surface of the grinding wheel, the pressure of said pressurized fluid being the sole source of energy for moving the abrasive particles and liquid through the apparatus.

2. An apparatus according to claim 1, wherein the lower end portion of said bypass conduit projects generally coaxially through said passageway and directly under said entrance opening so as to define an annular space therearound in which the abrasive particles accumulate.

3. An apparatus according to claim 1, wherein said blasting gun includes an interior chamber which coaxially communicates with a discharge nozzle and additionally includes a suction inlet which provides communication between said intermediate pipe and said interior chamber, said gun also having a jet member mounted thereon and connected at one end to a source of pressurized air, said jet member having a discharge end which projects into said interior chamber and terminates in an outlet which discharges a stream of pressurized air axially toward the discharge nozzle.

4. An apparatus according to claim 1, wherein the blasting gun includes a housing defining therein a first interior chamber which coaxially communicates with a discharge nozzle, the housing having a slurry inlet which connects to said intermediate pipe and communicates directly with said first interior chamber, said housing defining a second interior chamber which is generally aligned in upstream relationship from said first interior chamber and is separated therefrom by an intermediate nozzle, said housing having an air inlet formed therein and communicating with said second interior chamber for sucking in air from the surrounding atmosphere, and a jet member mounted on said housing and having one end thereof connected to an external source of pressurized liquid, said jet member having a terminal end portion which projects coaxially into said second interior chamber and which terminates in a discharge orifice which discharges a stream of liquid coaxially into said second interior chamber toward said intermediate nozzle in generally coaxial alignment with the discharge nozzle.

5. An apparatus according to claim 4, wherein said external source comprises a pressure intensifier having a driving liquid acting against a first piston which is directly drivingly coupled to a second piston of significantly greater cross-sectional area, and said second piston acting against and pressurizing a blasting liquid which is supplied to said jet member.

6. An apparatus for dressing a super abrasive grinding wheel, comprising:

a reservoir having an internal chamber for containing a slurry of liquid and abrasive particles, said reservoir having an upper portion and a funnel-shaped lower portion which tapers toward an outlet opening at a lower end of said lower portion, said reservoir being free of means for agitating the slurry so that said abrasive particles are free to settle into said lower portion of said reservoir whereby liquid substantially free of abrasive particles becomes present in said upper portion of said reservoir, said outlet opening of said reservoir being unobstructed so that abrasive particles that settle in said lower portion of said reservoir can freely flow downwardly through said outlet opening;

a connector structure disposed below said reservoir, said connector structure having a generally horizontally extending central passageway which is closed at one axial end thereof and which has discharge means in the opposite axial end thereof, said connector structure having a entrance opening extending upwardly from said passageway between said axial ends, said entrance opening having an upper end which opens into said outlet opening in said lower portion of said reservoir and is in free, open communication therewith, said outlet opening of said reservoir and said entrance opening of said connector structure being free of valve means so that abrasive particles in said outlet opening can freely flow downwardly through said entrance opening into said central passageway and accumulate therein;

said discharge means being an annular, mixing, discharge nozzle mounted in said opposite axial end of said passageway, said mixing nozzle having a tapered discharge opening which is in axial alignment with said passageway;

a bypass conduit having a lower end portion extending through said one axial end of said passageway and then extending under and beyond said entrance opening to a location close to said mixing, discharge nozzle, said end portion providing a zone between said bypass conduit and the wall of said passageway into which abrasive particles can freely flow from said entrance opening, said bypass conduit having an upper end which is connected to the upper portion of said reservoir so that liquid substantially free of abrasive particles can flow from said reservoir into said lower end portion of said bypass conduit and thence into said passageway close to said mixing nozzle, said bypass conduit being free of pumping means so that flow of liquid therethrough is caused by means located downstream of said mixing nozzle;

an intermediate pipe connected at one end thereof to said mixing nozzle for receiving a slurry therefrom;

a blasting gun connected to the other end of said intermediate pipe so that the slurry can flow into said blasting gun, and pump means connected in said intermediate pipe for supplying pressurized slurry to said blasting gun and to discharge a mist of the slurry at a pressure in the range of 2.0 to 3.5 kgf.cm.cm. for impingement against the peripheral surface of the grinding wheel, said pump being the sole source of energy for moving the abrasive particles and liquid through the apparatus.

* * * * *

UNITED STATES PATENT AND TRADEMARK OFFICE

CERTIFICATE OF CORRECTION

PATENT NO. : 5 115 600

DATED : May 26, 1992

INVENTOR(S) : Shigeaki Kataoka et al

It is certified that error appears in the above-identified patent and that said Letters Patent is hereby corrected as shown below:

On the title page of the patent please insert the following:

---[30] Foreign Application Priority Data

May 30, 1989 [JP] Japan. . . . . .1-134614---.

Column 9, line 59; change "connected to" to

---connected at---.

Column 11, line 4; change "a" to ---an---.

Signed and Sealed this

Twenty-first Day of September, 1993

Bruce Lehman

*Attest:*

BRUCE LEHMAN

*Attesting Officer*

*Commissioner of Patents and Trademarks*